US006203014B1

(12) United States Patent
de Caussin

(10) Patent No.: US 6,203,014 B1
(45) Date of Patent: Mar. 20, 2001

(54) THREE-DIMENSIONAL MAZE GAME

(75) Inventor: Matthew de Caussin, Northridge, CA (US)

(73) Assignee: Gambit Gameworks, Inc., Chatsworth, CA (US)

( * ) Notice: Subject to any disclaimer, the term of this patent is extended or adjusted under 35 U.S.C. 154(b) by 0 days.

(21) Appl. No.: 09/420,954

(22) Filed: Oct. 19, 1999

(51) Int. Cl.[7] ..... A63F 9/06
(52) U.S. Cl. ..... 273/153 R
(58) Field of Search ..... 273/153 R, 157 R; 283/63.1, 117

(56) References Cited

U.S. PATENT DOCUMENTS

| | | | | |
|---|---|---|---|---|
| D. 270,072 | | 8/1983 | Tobias . | |
| 1,189,598 | * | 7/1916 | McLean | 273/157 R |
| 2,548,043 | * | 4/1951 | Muhlhauser | 273/153 R X |
| 3,625,516 | | 12/1971 | Handweiler et al. . | |
| 3,785,651 | | 1/1974 | Smith . | |
| 4,008,529 | | 2/1977 | Yorkston . | |
| 4,180,268 | | 12/1979 | Brooks . | |
| 4,365,438 | | 12/1982 | Nelson . | |
| 4,588,210 | | 5/1986 | Tabatch et al. . | |
| 4,640,512 | * | 2/1987 | Burke | 273/157 R |
| 4,712,673 | | 12/1987 | Moore . | |
| 4,841,911 | | 6/1989 | Houghton . | |
| 4,861,036 | | 8/1989 | Watanabe . | |
| 5,226,822 | | 7/1993 | Morris . | |
| 5,281,039 | | 1/1994 | Hsiung et al. . | |
| 5,476,264 | | 12/1995 | Ortega . | |
| 5,558,520 | | 9/1996 | Wetzberger . | |
| 5,560,606 | | 10/1996 | David . | |
| 5,732,945 | * | 3/1998 | Sofia | 273/153 R X |
| 5,839,723 | | 11/1998 | Grimes . | |

FOREIGN PATENT DOCUMENTS

2244929 * 12/1991 (GB) ..... 273/153 R

OTHER PUBLICATIONS

Evans, Larry; "A Super–Sneaky Double–Crossing Up, Down Round & Round Maze Book;" Klutz; © 1998.

* cited by examiner

*Primary Examiner*—Raleigh W. Chiu
(74) *Attorney, Agent, or Firm*—Kelly Bauersfeld Lowry & Kelley, LLP

(57) ABSTRACT

A three-dimensional maze game. Vertical slices of a three-dimensional maze are displayed on a plurality of surfaces. The surfaces are retained relative to one another such that features common to adjacent slices remain in corresponding positions as a user moves from surface to surface while traversing the maze.

15 Claims, 4 Drawing Sheets

THREE-DIMENSIONAL MAZE GAME

BACKGROUND (1) Field of the Invention

The invention relates to a game. More specifically, the invention relates to a three-dimensional maze in the form of a book in which a user traverses the maze by passing through doorway which move the user through a page.

(2) Background

Numerous different puzzle books exist, including crossword puzzles, two-dimensional mazes, word searches, and things of that nature. Also existing are three-dimensional maze games, such as that disclosed in U.S. Pat. No. 4,180,286 issued to Brooks. That three-dimensional maze has a partial maze on a number of transparent elements which are retained in relation to one another, such that looking through, a user views the total maze pattern delimited. Grimes, U.S. Pat. No. 5,839,723, discloses a multi-layer game in which a steel ball is moved around the multi-level maze in the blind based on patterns shown on the front surface. Other such three-dimensional maze puzzles are also known in the art.

BRIEF SUMMARY OF THE INVENTION

A three-dimensional maze game is disclosed. Vertical slices of a three-dimensional maze are displayed on a plurality of surfaces. The surfaces are retained relative to one another such that features common to adjacent slices remain in corresponding positions as a user moves from surface to surface while traversing the maze.

DETAILED DESCRIPTION

In a typical embodiment of the labyrinth game, a plurality of pages, each having an image corresponding to one layer (vertical slice) of the labyrinth are bound together, using for example, a spiral binder or any other conventional binding. The front and back of each page is printed with a next adjacent layer of the labyrinth. The user traverses the labyrinth by passing through foreground and background portals, moving from chamber to chamber, page to page, from an entrance point to an exit point.

Figure 1:
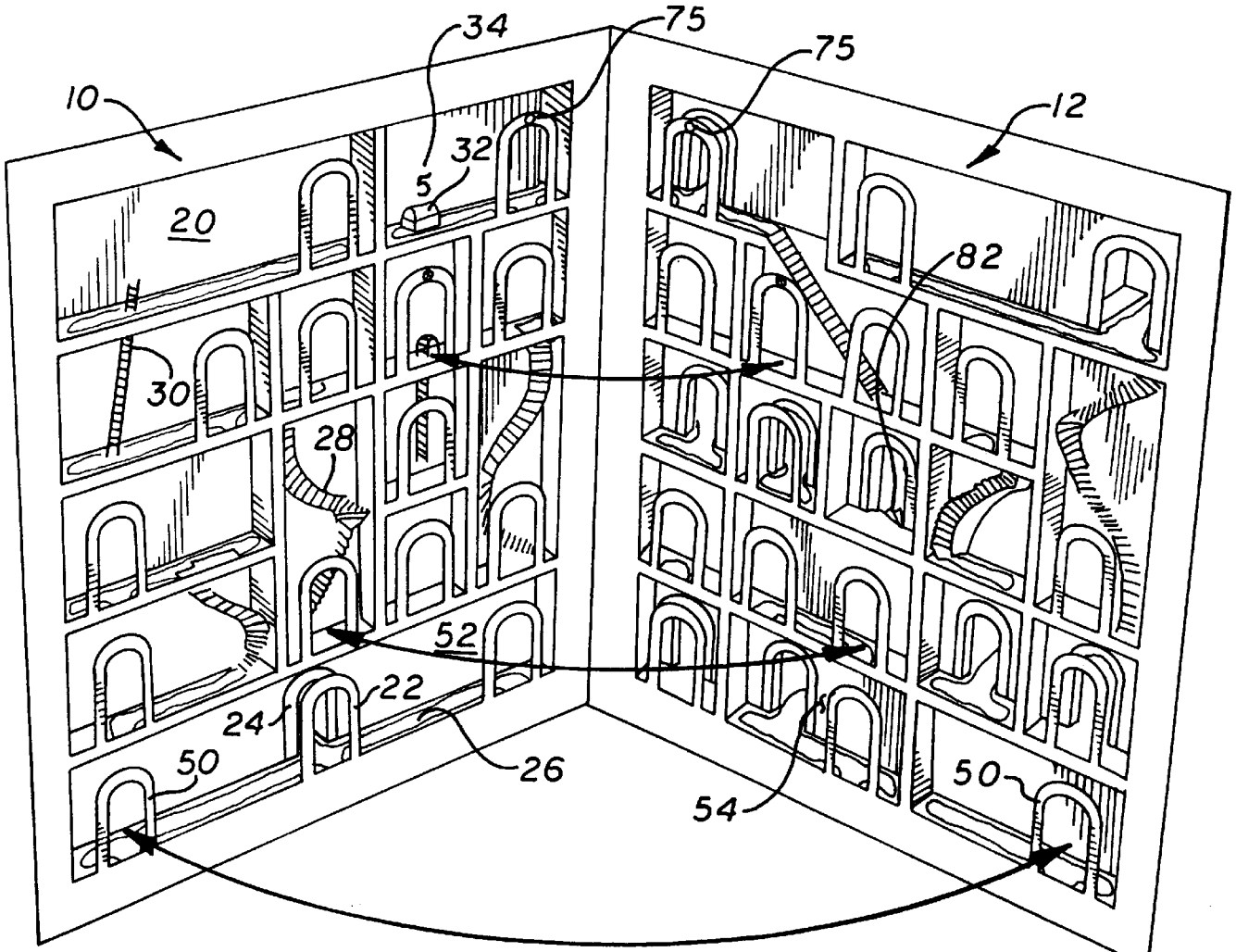
FIG. 1 is a schematic diagram of two images that form adjacent portions of a labyrinth of one embodiment of the invention.

FIG. 1 is a schematic diagram of two images that form adjacent portions of a labyrinth of one embodiment of the invention. First surface 10 has an image thereon of a first portion of a three-dimensional labyrinth. Each portion of the labyrinth has portals, such as foreground portal 22 and background portal 24 to permit the user to move to adjacent portions of the labyrinth. Horizontal movement of a user within a portion of the labyrinth is constrained by chambers or corridors, such as chamber 20. Vertical movement within a portion is permitted by ladders or stairways, such as stairway 28 or ladder 30. Because surface 10 is a left-hand surface, background portals move a user through the page to a previous right-hand page, while foreground portals move a user to a next adjacent facing right-hand page. The foreground portals on surface 10 are exactly mirrored on surface 12, as each of these portals permits a user to move from surface 10 to surface 12, and vice versa. Foreground portal 50 corresponds to foreground portal 50 on surface 10 and 12, respectively.

In one embodiment, the floor of the chamber has a path 26 depicted thereon. Path 26 shows a user where they are permitted to go. Thus, while it might appear that there is nothing between chamber 52 and chamber 54, in fact, an invisible wall is present separating those chambers. The only access from chamber 52 into chamber 54 is through foreground portal 22. The path also foreshadows a user's options looking through a portal. If, for example, looking through a portal, the user sees a break in the path outline on the right-hand side, that indicates that after passing through that portal a right turn is possible.

Figure 3:
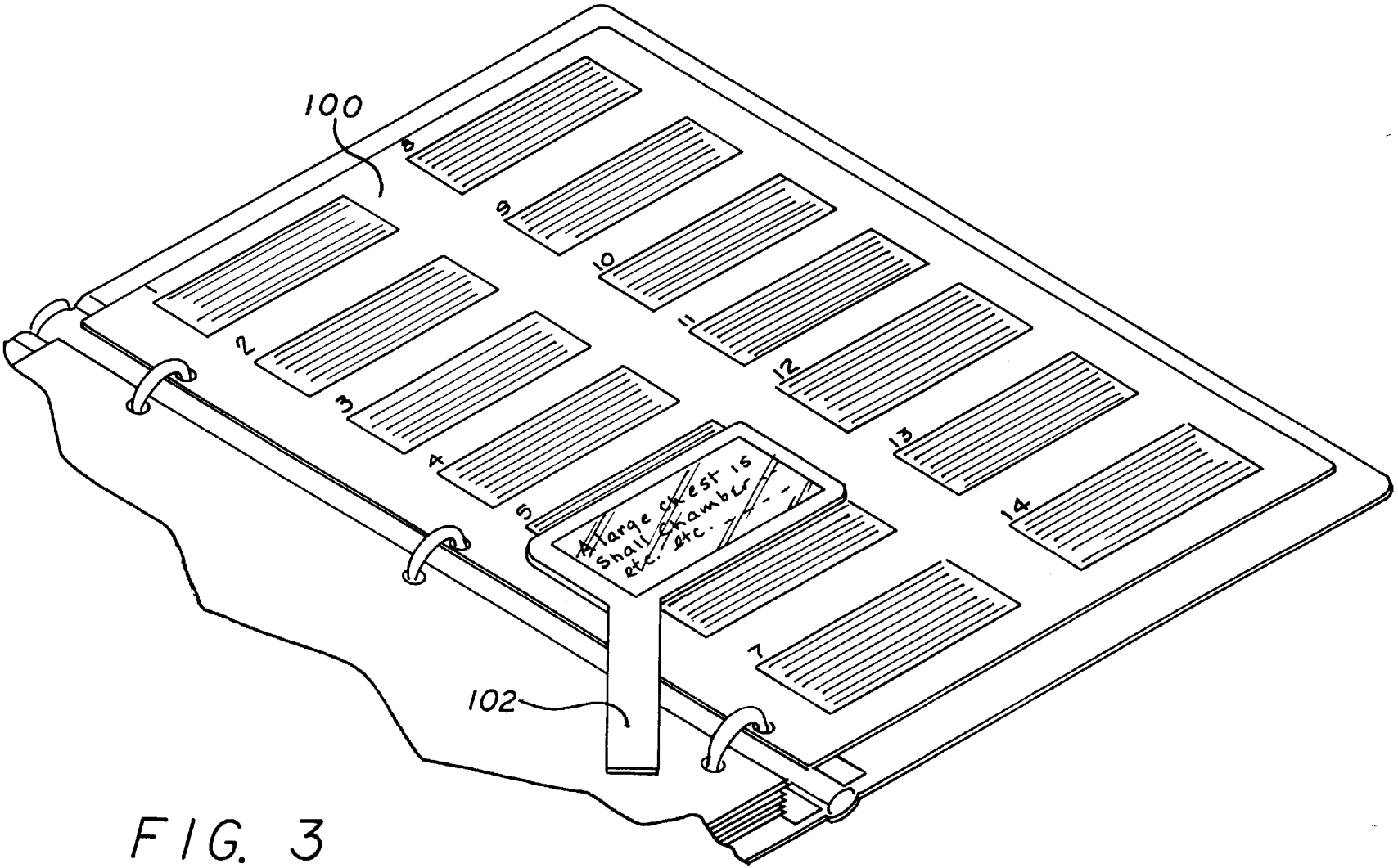
FIG. 3 is a diagram of an exemplary code page and decoder of one embodiment of the invention.

Some embodiments of the game include objects of interest, such as chest 32 within the labyrinth. Identification symbols, such as the numeral "5" 34, may be associated with each item of interest, in this case, chest 32. In other embodiments, the identification symbol may appear by itself. The identification symbol may be used to cross-reference into a code sheet 100, such as shown in FIG. 3, and a decoder 102 may be used to decode an encoded message associated with the identification symbol. In one embodiment, the message is encoded by printing the message in a light blue ink and over printing with red ink. In such an embodiment, the decoder has a transparent red filter to mask the over printing. Other encodings and decoders are within the scope and contemplation of the invention. These items of interest and encoded messages permit the maze to be played in a quest mode where the object of the quest, rather than merely finding the exit to the maze, may involve finding various items of interest to accumulate wealth, open locked doors, or otherwise enhance the playing experience. Of course, it is always possible to play a maze with such items of interest present, ignoring those items and merely trying to traverse the maze from entrance to exit.

Figure 2:
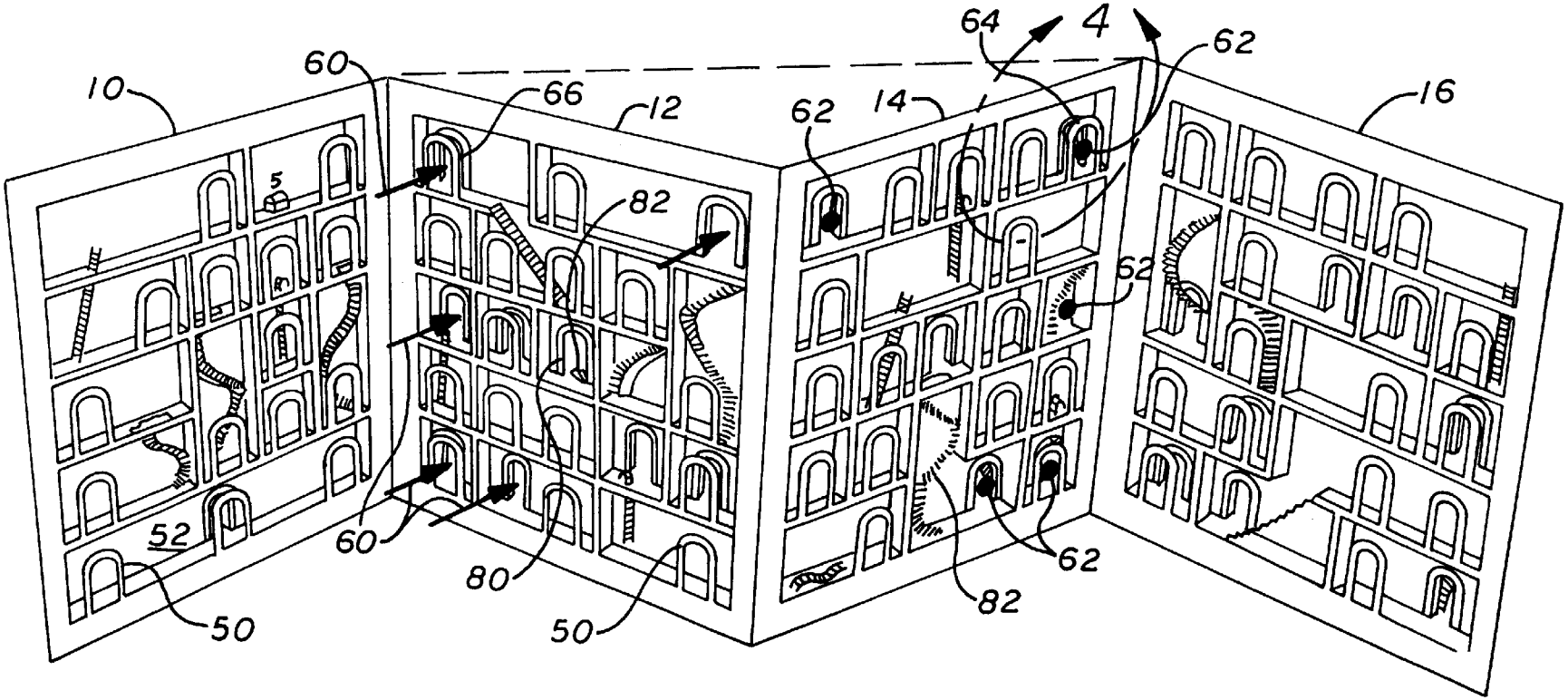
FIG. 2 is a schematic diagram showing four consecutive surfaces each having a portion of the labyrinth displayed thereon.

FIG. 2 is a schematic diagram showing four consecutive surfaces each having a portion of the labyrinth displayed thereon. On one embodiment, the labyrinth may be configured like a folding Chinese screen. It is preferred that the labyrinth be printed on front and back of pages in a book. In that embodiment, surface 12 and surface 14 could correspond to a front and back of a single page. Arrows 60 and circles 62 are provided in this figure for illustrations only. The arrows 60 each point through background portals on surface 12 and correspond to the circles 62 coming through background portals on surface 14. By passing through a background portal on a right-hand surface, such as surface 12, a user moves deeper into the labyrinth to the next deeper adjacent left-hand surface, in this case, surface 14. Conversely, by moving through a foreground portal on a left-hand surface, such as surface 10 or surface 14, a user moves to a deeper point in the maze. If the user moves through a foreground portal on a right-hand surface, such as surface 12, the user moves to a shallower point in the maze. As used herein, "deeper" means closer to the exit in horizontal distance, and "shallower" means closer to the entrance in horizontal distance.

In one embodiment, doorways are adorned with a unique symbol 75 to aide a user in finding a corresponding door on a previous or next surface. By unique symbol, it is meant that the symbol is unique to that portal and corresponding portals on an adjacent surface or surfaces, but may appear in the labyrinth more than once on different pages. These symbols help to prevent a user from skipping to an incorrect portal during a page turn.

Figure 4:
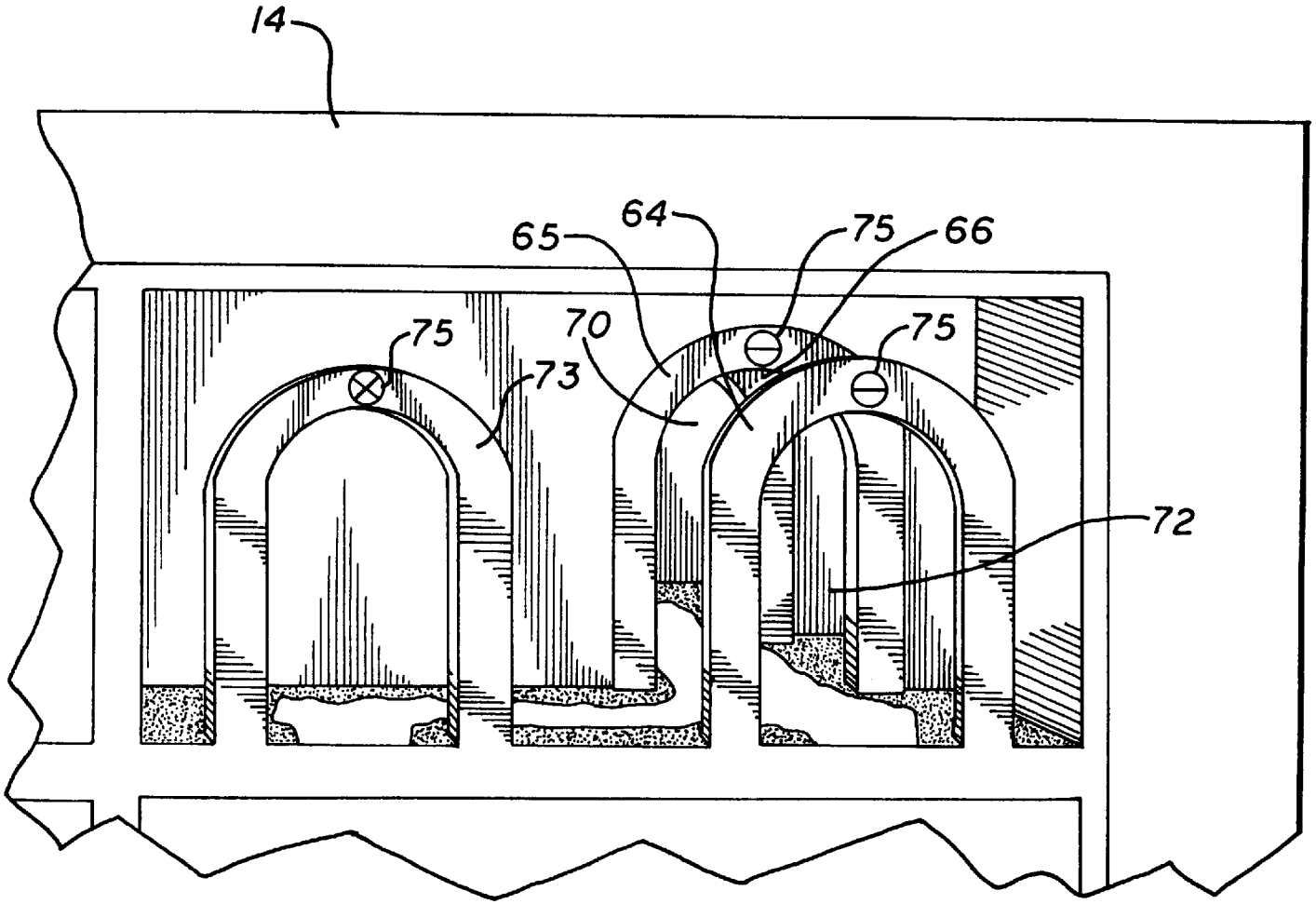
FIG. 4 shows an enlarged cutaway view of a subsection of one surface.

Notably, because the maze is perspectively correct from first person point of view, looking through a portal, a user can see a chamber or stairways or so forth that would be visible through that portal. FIG. 4 shows an enlarged cutaway view of a subsection of one surface. Looking at the depiction of background portal 65 on surface 14, the representation of foreground portal 66 from surface 12, as well as the rear wall of chamber 70 of surface 10 can be seen. Thus, by looking at the path, the user will be able to discern that e.g. in chamber 70, it is not possible for a user to turn to the right after passing through the doorway in the intermediate chamber, chamber 72, on surface 12. The user will similarly have an option of going left.

As another example (not shown in FIG. 4), from the view through doorway 80 on surface 12, a user would see the top of the staircase 82, which is shown on surface 14. Thus, the user's decision of which portal to pass through may be influenced by the options foreshadowed by the path and the other things visible through the portal. The maze book provides a visually stimulating three-dimensional maze experience, where each surface displays a portion of the labyrinth, for example, a vertical slice. Paging through the book, or moving from panel to panel on a screen, including backtracking as necessary, a user traverses the maze to find an exit and/or perform a quest.

FIG. 4 also illustrates an embodiment employing the unique symbols 75 on the portals. Portals 64, 65, and 66 would all have the same unique symbol as they represent a single linear path from page to page. However, portal 73 which does not correspond linearly with portal 64 has a different unique symbol.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense. Therefore, the scope of the invention should be limited only by the appended claims.

What is claimed is:

1. An apparatus comprising:

a first page having a front side and a back side, the front side having printed thereon a first representation of a first portion of a three-dimensional labyrinth, the representation including at least one portal through the first page, the back side of the first page having printed thereon a second representation of a second portion of the labyrinth; and a facing page having a front side and a back side, the front side having printed thereon a third representation of a third portion of the labyrinth, wherein passing through an exit in a background of the first representation moves a user to a corresponding position in the second representation and wherein passing through an exit in a foreground of the second representation moves a user to a corresponding position in the third representation.

2. The apparatus of claim 1 wherein each representation is perspectively correct from a first person perspective.

3. The apparatus of claim 1 wherein the labyrinth contains a plurality of items of interest, each identified by an identification symbol.

4. The apparatus of claim 3 further comprising:

a code page having an entry corresponding to each item of interest.

5. The apparatus of claim 4 further comprising:

a decoder for use with the code page.

6. The apparatus of claim 1 wherein each representation includes a pathway that foreshadows choice looking through a portal.

7. The apparatus of claim 1 wherein a unique symbol on at least one portal in the first representation is present on a corresponding portal on the second representation.

8. An apparatus comprising:

a first surface having displayed thereon a first representation of a first portion of a three-dimensional labyrinth;

a second surface having displayed thereon a second representation of a second portion of the labyrinth, the second surface retained adjacent to the first surface such that correspondence between an element common to the first representation and the second representation is maintained.

9. The apparatus of claim 8 wherein the first surface and the second surface are opposing sides of a single piece of material.

10. The apparatus of claim 8 wherein the first surface and the second surface are a same side of a piece of material separated by a fold line.

11. A game comprising:

a plurality of pages, each page having a representation of a portion of a three-dimensional labyrinth printed thereon, the portion being related to portions on each immediately adjacent page, wherein a user plays the game by traversing the labyrinth by passing through a portal in one representation to get to a next room in the next representation.

12. The game of claim 11 wherein the plurality of representation includes a subset of left-side representation and a subset of right-side representation.

13. The game of claim 11 wherein if the portal is a background portal, turning the page reveals the next representation.

14. The game of claim 11 wherein if the portal is a foreground portal, the next representation is on a facing page.

15. The game of claim 12 wherein passing through either a background portal in a right-side representation or a foreground portal in a left-side representation moves a user to a point deeper into the labyrinth, and wherein passing through either a foreground portal in the right-side representation or a background portal in a left-side representation moves the user to a shallower point in the labyrinth.

* * * * *